US005784943A

United States Patent [19]

Kahra

[11] Patent Number: 5,784,943

[45] Date of Patent: Jul. 28, 1998

[54] ARRANGEMENT IN A HYDRAULIC CYLINDER

[75] Inventor: Ossi Kahra, Lahti, Finland

[73] Assignee: Tamrock Oy, Tampere, Finland

[21] Appl. No.: 816,341

[22] Filed: Mar. 13, 1997

[30] Foreign Application Priority Data

Mar. 15, 1996 [FI] Finland ..... 961241

[51] Int. Cl.[6] ..... F15B 13/04

[52] U.S. Cl. ..... 91/28; 91/422; 91/436; 91/529

[58] Field of Search ..... 91/28, 422, 436, 91/529

[56] References Cited

U.S. PATENT DOCUMENTS

| | | | |
|---|---|---|---|
| 2,431,032 | 11/1947 | Ernst | 91/436 |
| 3,071,926 | 1/1963 | Olsen et al. | 91/436 |
| 3,447,424 | 6/1969 | Billings | 91/422 |
| 3,474,708 | 10/1969 | Schmiel | 91/436 |
| 3,592,108 | 7/1971 | Rosaen | 91/422 |
| 3,596,561 | 8/1971 | Keller | 91/436 |
| 3,817,152 | 6/1974 | Viron | 91/436 |
| 4,194,436 | 3/1980 | Imada | 91/436 |
| 4,509,405 | 4/1985 | Bates | 91/436 |
| 5,233,909 | 8/1993 | Von Hoene | 91/436 |

FOREIGN PATENT DOCUMENTS

| | | |
|---|---|---|
| 0 014 174 | 8/1980 | European Pat. Off. . |
| 0 327 666 | 8/1989 | European Pat. Off. . |
| 0 499 826 | 8/1992 | European Pat. Off. . |
| 0 578 820 | 1/1994 | European Pat. Off. . |
| 21 39 129 | 5/1972 | Germany . |
| 22 11 288 | 9/1972 | Germany . |
| 28 11 332 | 12/1978 | Germany . |
| 41 04 856 | 10/1991 | Germany . |
| 40 36 564 | 5/1992 | Germany . |
| 359 897 | 9/1973 | Sweden . |
| 7115910 | 2/1975 | Sweden . |
| 1 282 101 | 7/1972 | United Kingdom . |
| 2 271 149 | 4/1994 | United Kingdom . |

*Primary Examiner*—F. Daniel Lopez
*Attorney, Agent, or Firm*—Smith-Hill and Bedell

[57] ABSTRACT

A hydraulic actuator includes three cylinder spaces: a first cylinder space (6) located between a ring piston and a cylinder; a second cylinder space (7) between the ring piston and an auxiliary piston inside a hollow piston rod connected to the ring piston; and the third cylinder space (8) formed between the ring piston, the cylinder and the hollow piston rod. The hydraulic actuator includes a non-return valve (11) mounted in the ring piston between the second cylinder space and the third cylinder space, allowing flow from the second cylinder space into the third cylinder space when pressure in the second cylinder space exceeds pressure in the third cylinder space; a non-return valve (10) mounted in the ring piston between the second cylinder space and the first cylinder space, allowing flow from the second cylinder space into the first cylinder space when pressure in the second cylinder space exceeds pressure in the first cylinder space; and a pressure limit valve (14) for controlling fluid flow into the cylinder spaces depending on pressure in the first channel when the actuator is lengthened.

9 Claims, 4 Drawing Sheets

ARRANGEMENT IN A HYDRAULIC CYLINDER

Figure 1:
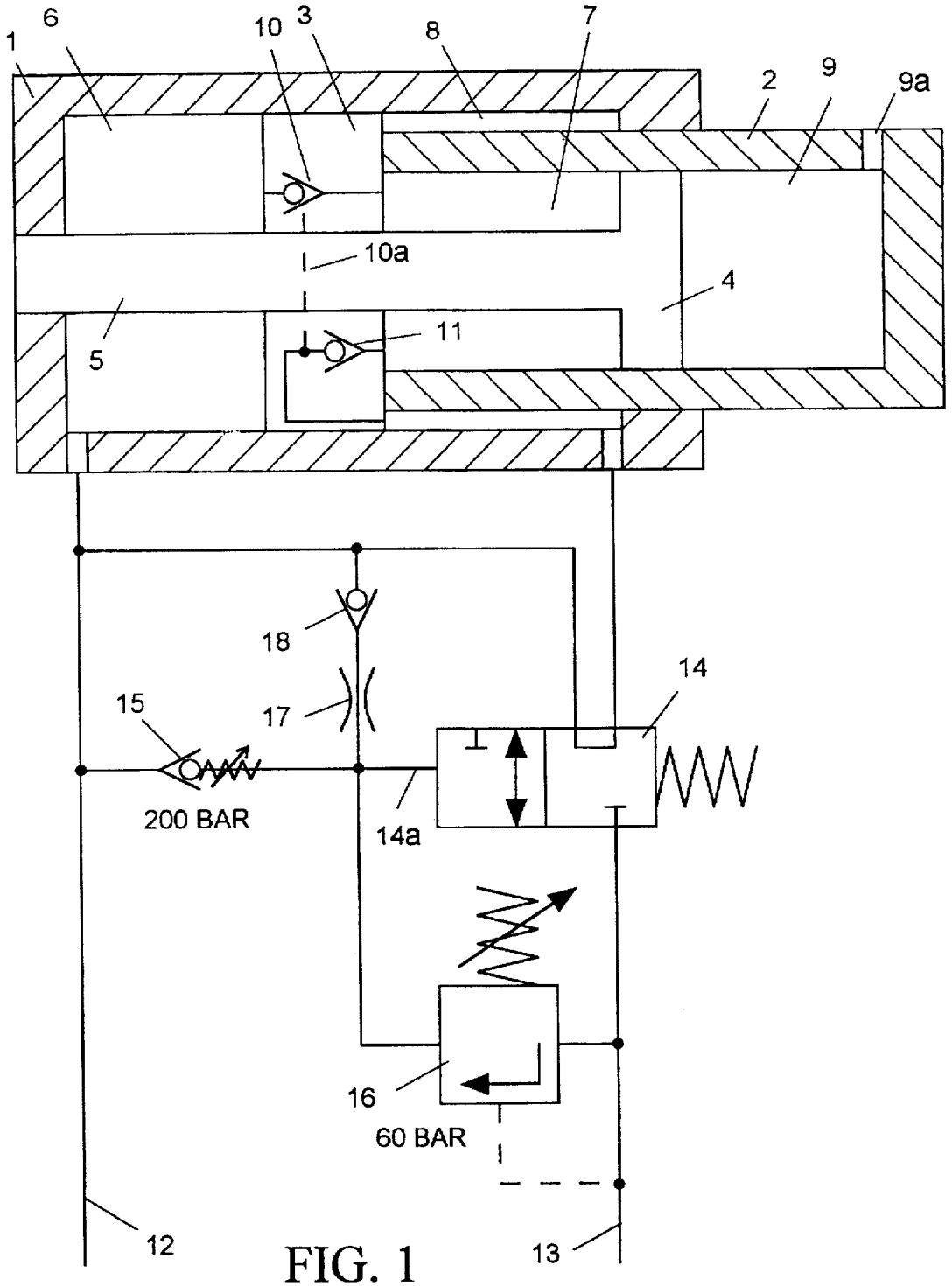

This invention relates to an arrangement in a hydraulic cylinder, which comprises a ring-shaped piston moving therein, to which piston is connected a hollow piston rod, inside the piston rod an auxiliary piston connected to the cylinder non-movable with respect to the cylinder by means of an auxiliary rod passing through the ring piston, at least three cylinder spaces, the first cylinder space located between the ring piston and the cylinder at the rear end of the cylinder and the second cylinder space in the space between the ring piston and the auxiliary piston inside the piston rod, the arrangement further comprising a first channel for feeding pressure fluid into the cylinder when it is lengthened and a second channel for feeding pressure fluid into the cylinder when it is shortened, valves for controlling the pressure fluid flow between the cylinder spaces and from the channels into the cylinder spaces and out of them and at least a first pressure limit valve for controlling the pressure fluid feed into the cylinder spaces depending on the pressure in the first channel when the cylinder is lengthened, so that, when the pressure caused by load resistance is lower than a predetermined level, the speed of motion of the cylinder piston is high and its force weak, respectively, and when the pressure exceeds said predetermined level, the force of the cylinder piston becomes stronger and the speed of motion lower, respectively.

Various demolition devices, such as breakers and tongs, are used for breaking concrete structures of different kinds, such as beams, elements etc. Objects of use are various demolition works of buildings and separation of concrete material to be broken and reinforcements contained therein from each other. Such demolition devices are used mounted on booms of separate construction machines, whereby their operation is based on the use of hydraulic pressure caused by the hydraulic system of the construction machine. These demolition devices break material by pressing the object to be broken with great force, whereby the breaking is based on strong static pressure on a small area.

Normally, a stage of operation consisting of one compression lasts about 10 to 15 seconds. Since the initial stage of the compression, with jaws approaching the material to be broken, does not require any great force, the movement of the jaws should be as rapid as possible to reduce loss of time. Correspondingly, when the jaws of a demolition device press against the material to be broken, a great force should be at disposal in order that the breaking may take place as quickly and efficiently as possible. Because the size and thickness of the material to be broken vary, it is not possible to use a stationary setting of rapid movement, but the setting should be able to vary as per circumstances.

In fixed presses or other stationary devices, it is known to use hydraulic couplings, in which a rapid movement of the cylinder and moving from a rapid movement to compression are arranged by separate hydraulic systems or components outside the hydraulic cylinder or by pressure raisers of different kinds. It is difficult to apply these solutions to mobile breaking tongs, because the sensitivity to damage is high due to complicated structures and tubings and in addition, flow losses in various tube systems decrease their operating power.

Further, solutions are known, in which a rapid movement is restricted to a predetermined fixed length of movement, a rapid movement is possible only in one direction or it is controlled by means of a valve separate from the rest of the operation. A drawback of such solutions is that they are poorly suited for a use in which the size of the object changes continuously and in consequence of that, the length of the rapid movement must be able to change together with the object in both directions of motion.

Above solutions are known e.g. from the publications DE-21 39 129, DE-22 11 288, DE-28 11 332, DE-40 36 564, DE-41 04 856, SE-359 897 and SE-373 914.

German Offenlegungsschrift 41 04 856 discloses a solution according to which two pistons having different pressure surfaces are connected to the same piston rod in the same cylinder. A rapid movement in both directions of motion is provided by feeding pressure fluid to either side of the piston having the smaller pressure surface and a demolition force is provided by feeding pressure medium in the pressing direction to the same pressure surface of both pistons. During the rapid movement, the cylinder spaces of the bigger piston are interconnected in such a way that pressure fluid may flow from one space into another permitting a movement of the piston. Moving from the rapid movement to demolition occurs by means of a pressure detector connected to the pressure channel of the smaller piston, whereby the pressure in said channel rises with increasing pressure resistance and when the pressure exceeds a predetermined value, the pressure detector brings the pressure channel of the bigger cylinder into connection with a hydraulic pump so hat pressure fluid flows behind both pistons and the common pressure surface of the pistons provides the desired pressing force. The weakness of the solution disclosed by the publication is that a complicated tubing is required for enabling the solution to function at all. Further, a pressure fluid flow between the cylinder spaces of the bigger cylinder supposes that, during a rapid movement, pressure fluid can be absorbed from a pressure fluid tank into one cylinder space of the bigger piston or a separate pressure fluid feeder circuit is required for feeding fluid into the circuit formed by the cylinder spaces, because due to the piston rod, the pressure surfaces of the cylinder spaces are of different sizes and so the pressure fluid flow as per length of movement is different in different cylinder spaces.

GB Patent Application 2 271 149 discloses a solution according to which oil moves from a cylinder space into another by means of a separate valve mounted on the side of the cylinder. In this solution, both a rapid movement and a slow movement with a great force are possible in both directions of motion, but the fluid flow and the control of the operation are implemented completely by components from outside the device and by electrically controlled valves, whereby each movement requires a separate control step. Also this solution requires complicated valve and tube structures, which make it difficult to apply to moving devices.

The object of the present invention is to provide an arrangement in which all operations can be effected automatically as per circumstances and in which only two hydraulic channels are needed for driving the cylinder in such a way that a pressing or lengthening movement is provided by feeding pressure fluid through the first channel and, respectively, a return movement is provided by feeding pressure fluid through the second channel and in which the cylinder force changes automatically when the force resisting to the movement exceeds the predetermined value.

The arrangement according to the invention is characterized in that the third cylinder space is formed between the ring piston and the piston rod and the cylinder, that non-return valves are mounted in the ring piston between the second cylinder space and the first cylinder space and, respectively, between the second cylinder space and the third cylinder space, so that pressure fluid can flow freely from the second cylinder space into the other cylinder spaces when the pressure in the second cylinder space exceeds the pressure in those others, that the first channel is connected to the first cylinder space, that the first pressure limit valve is connected to control the pressure fluid flow, when it is fed into the cylinder, in such a way that when the pressure in the first channel is lower than the set value of the pressure limit valve, the first and the third cylinder space are connected directly to each other while the pressure fluid flow into the second channel is prohibited, and that when the pressure in the first channel exceeds the set value of the pressure limit valve, it breaks the direct connection between the first cylinder space and the third cylinder space and, respectively, connects the second channel to the third cylinder space permitting pressure fluid to flow out of the second and the third cylinder space through the second channel.

An essential idea of the invention is that the channels required for providing a rapid movement and the valves required for closing the channels are formed in the piston, due to which separate channel systems and external loose valves are not needed. Another essential idea of the invention is that a rapid movement at pressing stage occurs merely by feeding more pressure fluid into the cylinder, whereby only differences between the pressure surfaces of the piston and the cylinder spaces are utilized and no flow into a pressure fluid tank or from there into the cylinder is needed in the return channel. Still another essential idea of the invention is that changing over from a rapid movement to a strong slow pressing movement is performed by controlling the pressure fluid flowing out of the pressure fluid spaces of the cylinder to flow into the pressure fluid tank when the pressing resistance exceeds a predetermined value, due to which no pressure fluid is flowing out of the other cylinder spaces into the pressing cylinder space any longer, but the entire pressure surface of the pressing cylinder can be used for providing a sufficient pressing force.

The invention is described in greater detail in the attached drawings, in which

Figure 2:
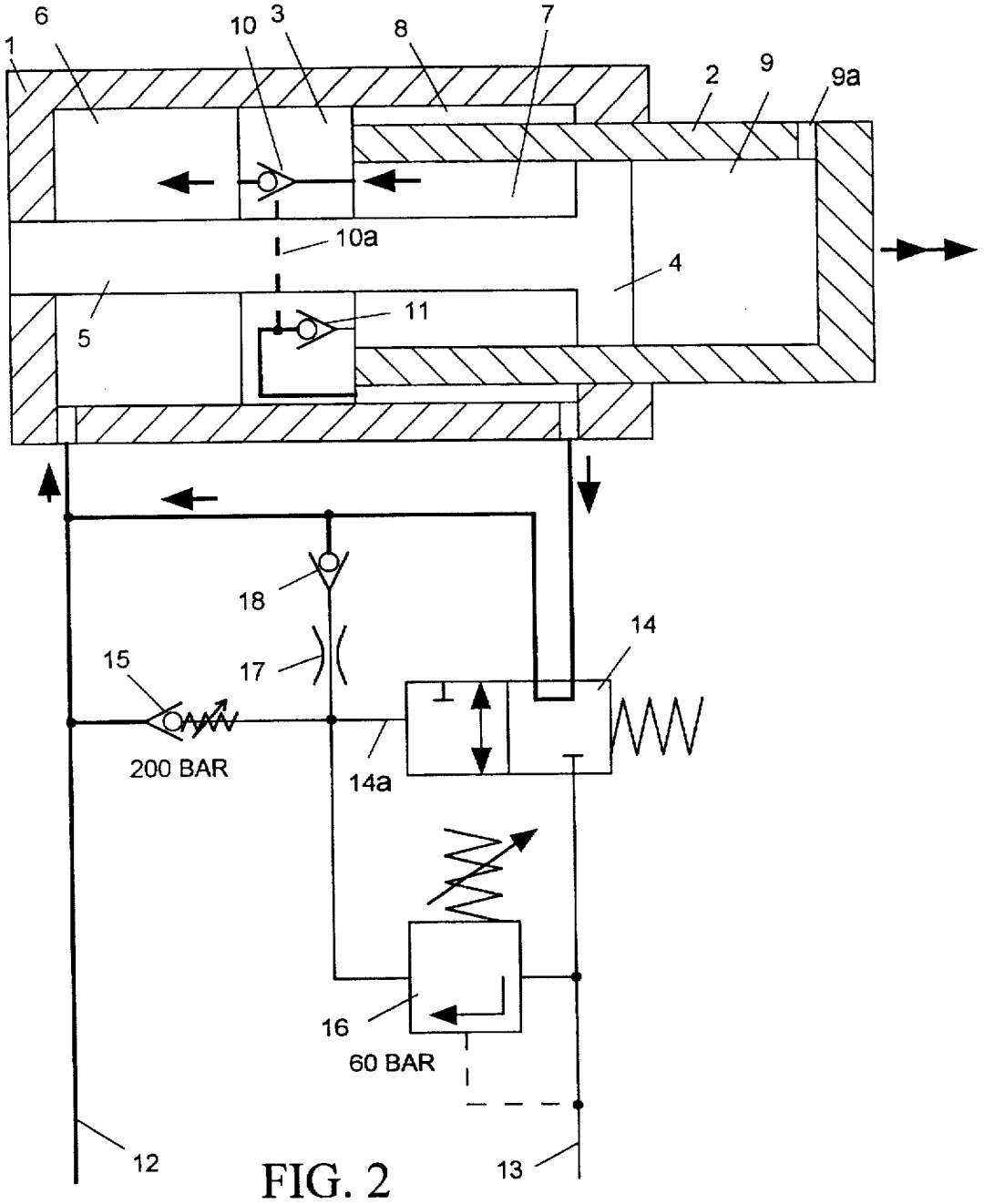
Figure 3:
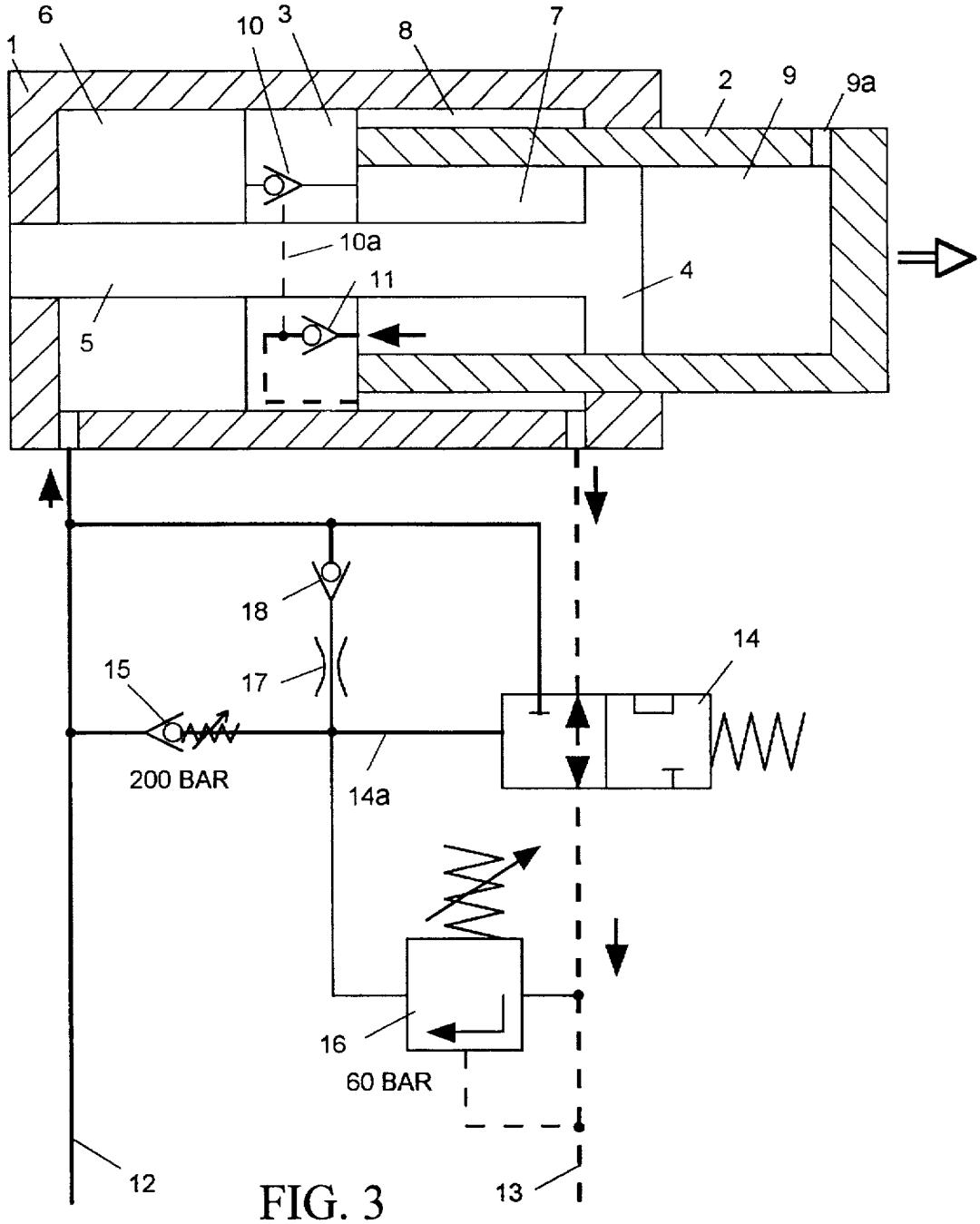
Figure 4:
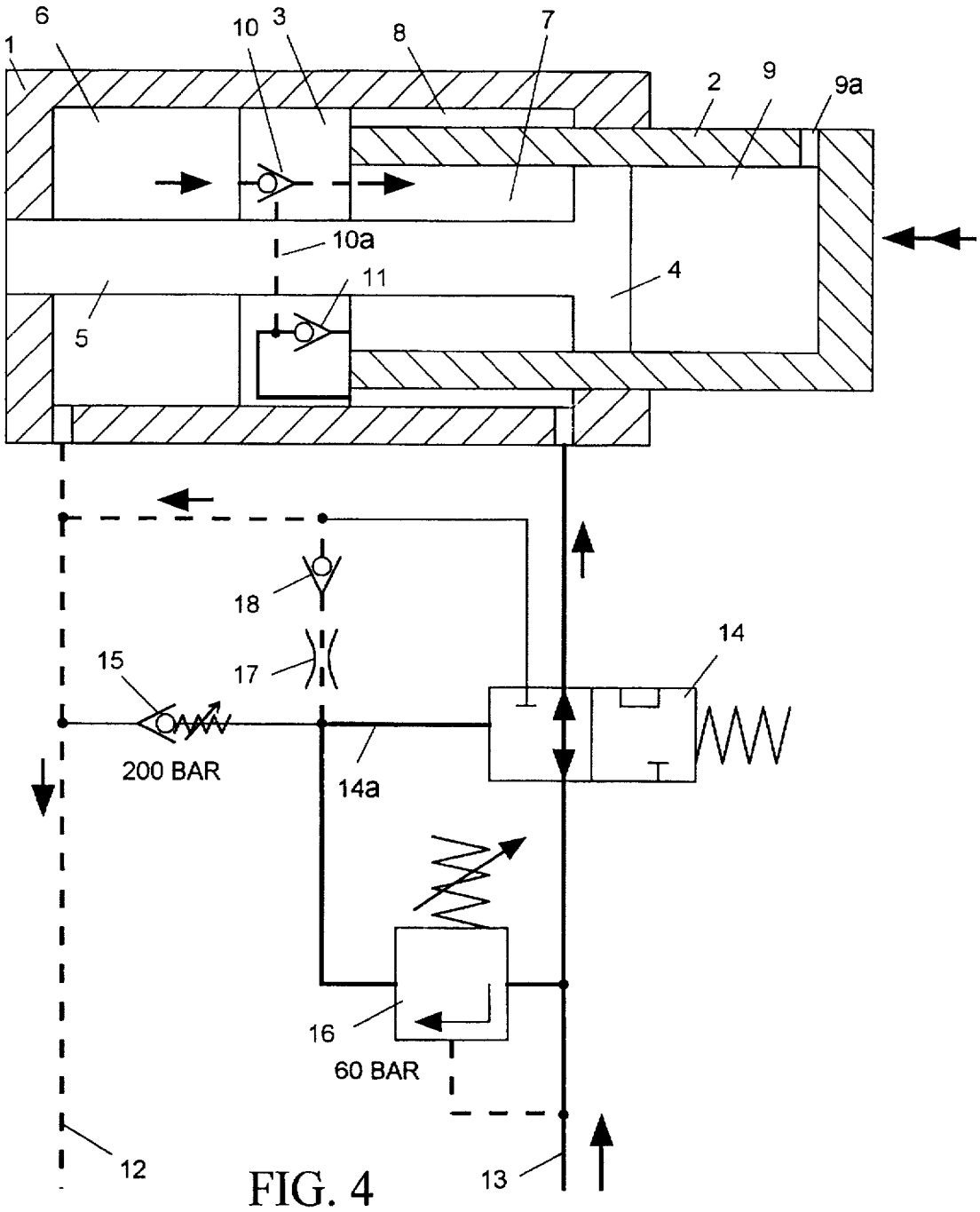

FIG. 1 shows an arrangement according to the invention schematically,

FIG. 2 shows the arrangement according to FIG. 1 during a rapid movement schematically, with pressurized channels in bold and flow directions of pressure fluid indicated by arrows, FIG. 3 shows the arrangement according to FIG. 1 during demolition stage, with pressurized channels in bold and flow directions of pressure fluid indicated by arrows and FIG. 4 shows the arrangement according to FIG. 1 during a return movement schematically, with pressurized channels in bold and flow directions of pressure fluid indicated by arrows.

FIG. 1 shows an arrangement according to the invention, which comprises a hydraulic cylinder 1. The cylinder contains a piston comprising a hollow piston rod 2 and a ring piston 3 attached thereto. Inside the piston rod 2 there is an auxiliary piston 4 connected to the cylinder 1 immovably in the axial direction by means of an auxiliary rod 5 passing through the ring piston 3. Between the ring piston 3 and the cylinder 1 at the rear end of the cylinder, there is a first cylinder space 6, inside the piston rod 2 remains a second cylinder space 7 restricted by the ring piston 3, the auxiliary piston 4 and the auxiliary rod 5, and between the piston rod 2 and the ring piston 3 and the cylinder 1 remains a narrow third cylinder space 8. In addition, inside the piston rod 2 remains a fourth space 9, which normally can be left unused and is connected through a channel 9*a* to outdoor air, for instance. The ring piston 3 comprises non-return valves 10 and 11 connected between the separate cylinder spaces. A connection for pressure fluid from the second cylinder space 7 through a pressure-controlled non-return valve 10 to the first cylinder space 6 is established in such a way that when the pressure fluid pressure is higher in the cylinder space 7 than in the cylinder space 6, the pressure fluid can flow freely into the cylinder space 6. Correspondingly, a non-return valve 11 leads from the second cylinder space 7 to the third cylinder space 8 in such a way that when the pressure is higher in the cylinder space 7 than in the cylinder space 8, the pressure fluid can flow freely into the cylinder space 8. Further, a control channel 10*a* of the pressure-controlled non-return valve 10 is connected to the third cylinder space 8 and the valve 10 is thus connected to be controlled under the influence of the pressure in the third cylinder space 8 in such a way that when there is pressure in the cylinder space 8, it opens the pressure-controlled non-return valve 10 and permits the pressure fluid to flow from the first cylinder space 6 into the second cylinder space 7.

FIG. 1 shows further a first and a second channel 12 and 13 for pressure fluid, through which channels pressure fluid can be fed to the cylinder 1. The first channel 12 is connected directly to the first cylinder space 6. On the other hand, to the second channel 13 is connected a control valve 14, which is in its basic position in FIG. 1, i.e. in a position which it has also when no pressure whatever prevails in the channels 12 and 13. In this position, there is a connection from the channel 12 over the valve 14 to the third cylinder space 8. The valve 14 is a pressure-controlled valve and its control channel 14*a* is connected to the first channel 12 by means of a pressure limit valve 15. The pressure limit set for the pressure limit valve 15 is the pressure value by which a rapid movement shall be changed into a slow pressing force. Further, the second channel 13 is connected to the control channel 14*a* of the valve 14 over a second pressure limit valve 16. Correspondingly, the pressure limit set for the second pressure limit valve is such a pressure value that the return movement of the cylinder takes place with sufficient force. The pressure limit valves 15 and 16 permit pressure fluid to flow through them in one direction supposing that the pressure acting over the valve exceeds its set value. In the other direction of the pressure limit valve, the pressure fluid flow is generally prohibited in a conventional manner, however. Still another connection is established from the control channel 14*a* of the valve 14 over a throttle 17 and a non-return valve 18 in series therewith to the first pressure fluid channel 12 in such a way that pressure fluid can flow from the control channel 14*a* into the first channel 12, but not the other way round.

FIG. 2 shows the arrangement of FIG. 1 in a situation when a rapid movement is just occurring in the cylinder. In this situation, there is pressurized fluid in the channel parts indicated in bold and pressure fluid is fed through the first hydraulic channel 12. With the valve 14 in the position according to the figure and with the pressure in the channel 12 below the set value of the valve 15, the set value being for instance 200 bar, pressure fluid flows from the channel 12 into the first cylinder space 6. Moreover, pressure fluid can flow from the second cylinder space 7 over the pressure-controlled non-return valve 10 into the first cylinder space 6, and from the third cylinder space 8 the pressure fluid can flow further over the valve 14 into the hydraulic channel 12 and thus into the first cylinder space 6. In this situation, a rapid movement is based merely on the difference between the surfaces of the cylinder spaces 6, 7 and 8 and no pressure fluid needs to be removed from the cylinders, because the pressure fluid leaving the cylinder spaces 7 and 8 can flow into the first cylinder space 6. In this way, even a small amount of pressure fluid effects a relatively big and rapid movement as long as the resisting force is small enough.

FIG. 3 shows the arrangement of FIG. 1 in a situation when the force resisting the movement of the cylinder is so great that the movement of the piston becomes slower or stops because of increasing resistance. In this situation, the pressure rises in the channel 12 till it exceeds for example 200 bar, which is the set value of the valve 15. In consequence of this, the control pressure is permitted to enter the control channel 14*a* of the valve 14, due to which the valve 14 changes its position and connects the third cylinder space 8 to the second channel 13. In this situation, the pressure from the second cylinder space 7 opens a connection over a non-return valve 11 to the third cylinder space 8, due to which the pressure fluid can flow out of these both through the channel 13. A high pressure prevails then in the first cylinder space 6 and the entire cross-sectional area of the ring piston 3 is subjected to pressure. This leads to a very great pressing force. If the load resistance decreases unexpectedly due to a material fracture, for instance, the pressure in the channel 12 may fall below the set value of the valve 15 and the valve 15 closes and prevents the control pressure from entering the valve 14. In order to avoid abrupt unnecessary to and from movements, the control channel 14*a* of the valve 14 can be discharged into the hydraulic channel 12 only over the throttle 17 and the non-return valve 18, which makes the valve 14 remain in the position according to FIG. 3 for a while also after a pressure drop. Only a pressure drop of longer duration makes the valve 14 return to the position according to FIG. 2.

FIG. 4 again shows a situation, when the cylinder is shortened by means of a rapid return movement. In this situation, pressure fluid is fed through the second channel 13, the valve 14 being at the initial moment in the position according to FIG. 1. When the pressure in the channel 13 exceeds the set value of the second pressure limit valve 16, e.g. 60 bar, said valve lets the pressure fluid flow into the control channel 14*a* of the valve 14 and moves the valve to the position shown in FIG. 4. In this situation the pressure fluid can flow into the third cylinder space 8, whereby the amount of the pressure fluid causes a rapid movement. Correspondingly, the pressure-controlled non-return valve 10 opens under the influence of the pressure in the third cylinder space 8 and lets the pressure fluid flow from the first cylinder space 6 into the second cylinder space 7, and thus only a slight amount of pressure fluid must be removed through the channel 12. Even though the control channel 14*a* of the valve 14 is connected over the throttle 17 and the non-return valve 18 to the hydraulic channel 12, the pressure fluid flow taking place that way is so slight that it does not essentially affect the operation of the valve 14.

The valves 14, 15, 16 and 18 and the throttle 17 can be constructed to form one whole, which can be fastened to the side of the cylinder 1 or which can form a stationary whole with and inside the cylinder. In both embodiments, only one pair of hydraulic channels for example from a demolition device to the carrier of a device driving it is required for driving the cylinder. When a very great pressing force is required, it is possible to utilize the fourth cylinder space 9 inside the piston rod 2, whereby pressure fluid can be led into said space either through the channel 9*a* or, for instance, by forming a hydraulic channel through the auxiliary piston 4 and its rod 5 for feeding pressurized fluid into the cylinder space 9. This retards rapid movements, however. In case of FIG. 2, a rapid movement requires a considerably bigger amount of pressure fluid and, respectively, in case of a return movement according to FIG. 4, a discharge of pressure fluid from the cylinder space 9 causes a force resisting the movement and thus retarding it. Instead of the second pressure limit valve 16, a non-return valve, for instance, can be used, which lets the pressure fluid in the channel 13 flow into the control channel 14*a* of the valve 4, but prevents the pressure fluid from the channel 12 from flowing into the channel 13. Then, of course, the acting force in the return movement can vary more than in the above solution.

I claim:

1. A control system for a hydraulic actuator, wherein the actuator comprises a cylinder; an annular ring piston slidably mounted within said cylinder, and connected to a hollow piston rod; and an auxiliary piston fixed to said cylinder by an auxiliary rod passing through the ring piston, said auxiliary piston slidably mounted within said hollow piston rod;

wherein a first cylinder space is located between said ring piston and said cylinder at a rear end of said cylinder, a second cylinder space is located between said ring piston and said auxiliary piston inside said hollow piston rod, and a third cylinder space is located between said ring piston, said hollow piston rod and said cylinder;

and the control system includes a first non-return valve mounted in said ring piston between said second cylinder space and said first cylinder space, allowing flow from said second cylinder space into said first cylinder space when pressure in said second cylinder space exceeds pressure in said first cylinder space; a second non-return valve mounted in said ring piston between said second cylinder space and said third cylinder space, allowing flow from said second cylinder space into said third cylinder space when pressure in said second cylinder space exceeds pressure in said third cylinder space; a first channel connected to said first cylinder space, for feeding pressure fluid into the actuator when it is lengthened; a second channel for feeding pressure fluid into the actuator when it is shortened; and a first pressure limit valve for controlling fluid flow into said cylinder spaces depending on pressure in said first channel when said actuator is lengthened;

wherein when pressure in said first channel is lower than a set value for said pressure limit valve, said third cylinder space is connected directly to said first cylinder space, while said third cylinder space is disconnected from said second channel, allowing for high speed and low force; and wherein when said pressure in said first channel exceeds said set value for said pressure limit valve, said third cylinder space is connected directly to said second channel, while said third cylinder space is disconnected from said first cylinder space, permitting pressure fluid to flow out of said second and said third cylinder space through said second channel and thereby allowing for higher force and lower speed.

2. The control system according to claim 1, wherein there is a pressure-controlled control valve having a first position wherein said third cylinder space is connected to said first cylinder space, and disconnected from said second channel; and a second position wherein said third cylinder space is connected to said second channel, and disconnected from said first cylinder space; and wherein said first pressure limit valve is connected between said first channel and a control channel of said pressure-controlled control valve so that when said pressure in said first channel exceeds said set value of said pressure limit valve, said control valve is moved to its second position.

3. Arrangement according to claim 2, wherein said first non-return valve is a pressure-controlled non-return valve, having a control channel which is connected to said third cylinder space.

4. Arrangement according to claim 3, wherein a second pressure limit valve is connected from said second channel to said control channel of said pressure-controlled control valve, wherein when pressure in said second channel exceeds a set value of said second pressure limit valve, said second pressure limit valve connects said second channel to said control channel of said pressure-controlled control valve, to move said pressure-controlled control valve to said second position so that said second channel is connected to said third cylinder space.

5. Arrangement according to claim 4, wherein a throttle in series with a third non-return valve is connected between said control channel of said pressure-controlled control valve and said first channel, wherein said third non-return valve prevents flow from said first channel to said control channel of said pressure-controlled control valve, but permits flow through said throttle from said control channel of said pressure-controlled control valve to said first channel when pressure in said first channel is lower than pressure in said control channel of said pressure-controlled control valve.

6. Arrangement according to claim 5, wherein said first and second pressure limit valves, said pressure controlled control valve, and said throttle and third non-return valve are mounted to form an integral whole.

7. Arrangement according to claim 6, wherein said integral whole is formed as part of said cylinder to form a stationary whole therewith.

8. Arrangement according to claim 6, wherein said integral whole is formed as a separate control block fastened to said cylinder.

9. Arrangement according to claim 1, wherein said first non-return valve is a pressure-controlled non-return valve, having a control channel which is connected to said third cylinder space.

* * * * *